US006930452B2

(12) United States Patent
De Krijger et al.

(10) Patent No.: US 6,930,452 B2
(45) Date of Patent: Aug. 16, 2005

(54) CIRCUIT ARRANGEMENT

(75) Inventors: Jozef Petrus Emanuel De Krijger, Geldrop (NL); Armand Boudewijn Perduijn, Eindhoven (NL); Engbert Bernard Gerard Nijhof, Eindhoven (NL); Marcel Johannes Maria Bucks, Weert (NL)

(73) Assignee: Lumileds Lighting U.S., LLC, San Jose, CA (US)

( * ) Notice: Subject to any disclaimer, the term of this patent is extended or adjusted under 35 U.S.C. 154(b) by 0 days.

(21) Appl. No.: 10/684,066

(22) Filed: Oct. 9, 2003

(65) Prior Publication Data

US 2004/0130518 A1 Jul. 8, 2004

(30) Foreign Application Priority Data

Oct. 14, 2002 (EP) ..... 02079326

(51) Int. Cl.[7] ..... H05B 37/00

(52) U.S. Cl. ..... 315/192; 315/307; 315/308

(58) Field of Search ..... 315/307, 308, 315/185 R, 192

(56) References Cited

U.S. PATENT DOCUMENTS 4,675,575 A * 6/1987 Smith et al. ..... 315/185 S
6,362,578 B1 * 3/2002 Swanson et al. ..... 315/307

* cited by examiner

*Primary Examiner*—David Vu
(74) *Attorney, Agent, or Firm*—Patent Law Group LLP

(57) ABSTRACT

In a circuit arrangement for driving a LED array comprising red, green and blue LEDs, a control loop is added for limiting the duty cycles of the control signals for driving the red, green and blue LEDs. In case one of the duty cycles reaches the limit value, the reference signals for the red, green and blue light are decreased with the same relative amount. The color point of the light is thereby maintained, even when the efficiency of part of the LEDs decreases.

9 Claims, 1 Drawing Sheet

CIRCUIT ARRANGEMENT

BACKGROUND

1. Field of the Invention

The invention relates to a circuit arrangement for operating a LED array and comprising

- a first LED driver for supplying a current to a first part of the LEDs in the LED array and equipped with
  - a first switching means for adjusting the amount of current supplied to the first part of the LEDs,
  - a first control circuit for generating a first control signal for controlling the conductive state of the first switching means,
  - a first control loop for controlling the amount of light generated by the first part of the LEDs at a level represented by a first reference signal by adjusting the duty cycle of the first control signal,
- a second LED driver for supplying a current to a second part of the LEDs in the LED array and equipped with
  - a second switching means for adjusting the amount of current supplied to the second part of the LEDs,
  - a second control circuit for generating a second control signal for controlling the conductive state of the second switching means,
  - a second control loop for controlling the amount of light generated by the second part of the LED at a level represented by a second reference signal by adjusting the duty cycle of the second control signal.

The invention also relates to a liquid crystal display unit and a back light for use in a liquid crystal display unit.

2. Description of Related Art

A circuit arrangement as mentioned in the opening paragraph is known. The known circuit arrangement is in addition to the first and second LED driver equipped with a third LED driver comprising a third control loop for controlling the amount of light generated by a third part of the LEDs. In case the known circuit arrangement is used to operate a LED array with red, green and blue LEDs, the first, second and third LED driver drive the red, green and blue LEDs respectively. White light of different colors can be generated by the known circuit arrangement by adjusting the amounts of red, green and blue light generated by the LED array. Since each of the LED drivers is equipped with its own control loop for controlling the amount of generated light, a small decrease in the efficiency of the LEDs is compensated by the control loop by installing a slightly bigger duty-cycle. In that way the color and the amount of white light are both controlled by the first, second and third control loop. However, the efficiency of LEDs, more in particular LEDs generating red light, is very strongly influenced by temperature and by aging of the LEDs. As a consequence, the duty cycle of the control signal of the switching means of the LED driver that drives the red LEDs can in practice often become equal to 100%. In case the duty cycle is encoded as a binary figure in a memory, the memory can overflow resulting in instabilities such as flashing. Furthermore, since the duty cycle cannot increase to values higher 100%, a further decrease in the efficiency of the red LEDs results in an undesired color shift of the "white" light, since the LED array is not generating enough red light.

The same problem as described hereabove can also occur in case the circuit arrangement comprises only two LED drivers, because the desired color of the light generated by the LED array can be generated by mixing only two colors instead of three.

SUMMARY

The invention aims to provide a circuit arrangement in which the disadvantages described hereabove are counteracted to a large extent.

A circuit arrangement as described in the opening paragraph is therefor according to the invention characterized in that the circuit arrangement is further equipped with a relative intensity control loop for limiting the duty cycles of the first and second control signal to a limit value by decreasing the values of the first and second reference signal by the same relative amount.

The relative intensity control loop in a circuit arrangement according to the invention limits the duty cycles of the control signals and thereby prevents flashing Additionally the relative intensity control loop preserves the ratio between the first and second reference signal values, since they are both decreased by the same relative amount. As a result the color of the light generated by the LED array does not change as a result of the limitation of one of the duty cycles, since the ratio between the reference signal vales and thus the ratio between the amount of light generated by the first part of the LEDs and the amount of light generated by the second part of the LEDs remains unchanged.

In a preferred embodiment of a circuit arrangement according to the invention, the circuit arrangement is further equipped with

- a third LED driver for supplying a current to a third part of the LEDs in the LED array and equipped with
  - a third switching means for adjusting the amount of current supplied to the third part of the LEDs,
  - a third control circuit for generating a third control signal for controlling the conductive state of the third switching means,
  - a third control loop for controlling the amount of light generated by the third part of the LEDs at a level represented by a third reference signal by adjusting the duty cycle of the third control signal.

Additionally the relative intensity control loop comprises means for limiting the duty cycles of the first, second and third control signal to a limit value by decreasing the values of the first, second and third reference signal by the same relative amount. This preferred embodiment is very suitable for use in the many applications in which white light is generated making use of a LED array comprising LEDs for generating red, green and blue light.

It has been found that the relative intensity control loop can be realized in a comparatively simple and dependable way in case it comprises

- a first circuit part coupled to the control circuit of each of the LED drivers for sampling the duty cycles of the control signals and selecting the highest duty cycle,
- a first comparator coupled to the first circuit part for comparing the highest duty cycle with a fourth reference signal representing a limit value of the duty cycle and for generating a first error signal depending on the outcome of the comparison,
- a second circuit part coupled to the first comparator for generating a parameter $\lambda$ depending on the first error signal,
- a multiplier coupled to the second circuit part and to the LED drivers to adjust the values of the reference signals representing a desired light level, by multiplying them with $\lambda$.

Although the relative intensity control loop ensures that the color of the light generated by the LED array is not affected by a strong decrease in the efficiency of (part of) the LEDs, the absolute intensity of the light may still vary very strongly as a result of such an efficiency decrease caused by e.g. changes in temperature. Such intensity variations can be suppressed by equipping the circuit arrangement with an absolute intensity control loop. In a circuit arrangement according to the invention in which the relative intensity control loop comprises a first and a second circuit part, a comparator and a multiplier, good results have been obtained in case the absolute intensity control loop comprises a second comparator for comparing a signal representing the actual light intensity with a signal representing the desired light intensity and for generating a second error signal depending on the outcome of the comparison, a third circuit part coupled between the first and the second comparator for generating the fourth reference signal representing a limit value of the duty cycle.

Good results have more in particular been obtained for embodiments, wherein the signal representing the actual light intensity is a signal representing the actual light intensity of the green light generated by the LED array. The amount of green light approximately equals the amount of light that passes a CIE-Y filter. This latter amount is defined as the intensity in CIE.

A circuit arrangement according to the invention is very suitable for use in a back light that is used in a liquid crystal display unit comprising a LED array.

BRIEF DESCRIPTION OF THE DRAWINGS

An embodiment of a circuit arrangement according to the invention will be described making reference to a drawing. In the drawing

DETAILED DESCRIPTION

Figure 1:
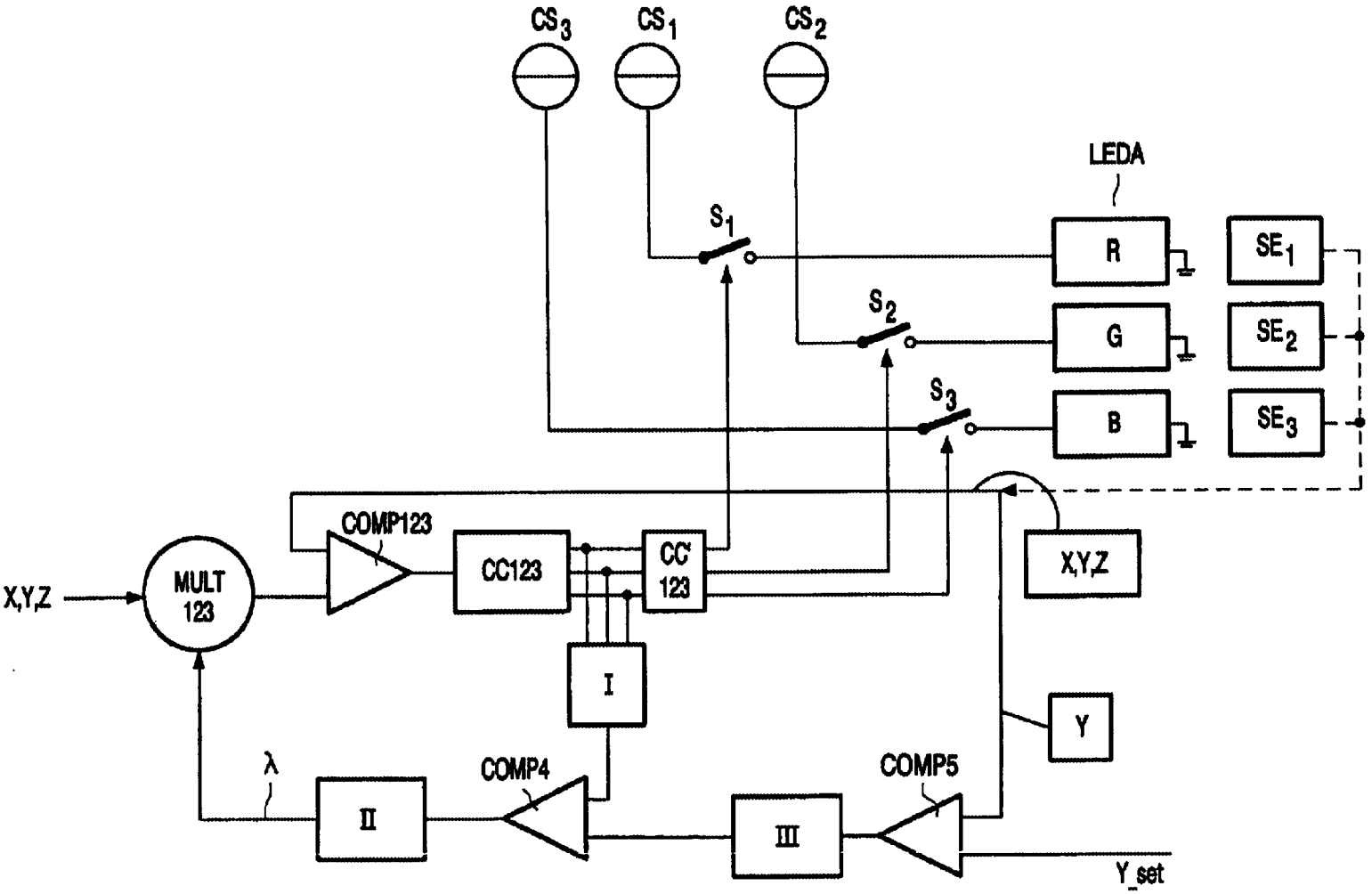
FIG. 1 shows a schematic diagram of an embodiment of a circuit arrangement according to the invention connected to a LED array.

In FIG. 1, LEDA is a LED array. R, G and B are a first, second and third part of the LEDs respectively. During operation these parts R, G and B respectively generate red, green and blue light. The parts R, G and B are connected respectively to current sources CS1, CS2 and CS3 by means of respectively switches S1, S2 and S3. In the embodiment shown in FIG. 1, switches S1, S2 and S3 form respectively a first switching means, a second switching means and a third switching means. SE1, SE2 and SE3 are sensors for sensing respectively the amount of light generated by the parts R, G and B of the LED array LEDA. Output terminals of the sensors SE1, SE2 and SE3 are connected to respective first input terminals of comparators COMP1, COMP2 and COMP3. In order to simplify the schematic representation presented in FIG. 1, the three comparators are represented by a single symbol with the reference COMP123. Respective second input terminals of the comparators COMP1, COMP2 and COMP3 are connected to the output terminals of multipliers MULT1, MULT2 and MULT3 respectively. Also the multipliers MULT1, MULT2 and MULT3 are shown in FIG. 1 as a single symbol with the reference MULT123. Respective output terminals of the comparators COMP1, COMP2 and COMP3 are connected to respective input terminals of circuit parts CC1, CC2 and CC3. Respective output terminals of circuit parts CC1, CC2 and CC3 are connected to input terminals of circuit parts CC'1, CC'2 and CC'3 respectively. The output terminals of circuit parts CC1, CC2 and CC3 are connected to respective control electrodes of switching elements S1, S2 and S3. Circuit part CC1 and CC'1 together form a first control circuit for generating a first control signal for controlling the conductive state of the first switching means. Similarly circuit parts CC2 and CC'2 together form a second control circuit for generating a second control signal for controlling the conductive state of the second switching means. Circuit parts CC3 and CC'3 together form a third control circuit for generating a third control signal for controlling the conductive state of the third switching means. CC1, CC2 and CC3 are circuit parts for generating a signal that respectively represents a duty cycle of the first control signal, a duty cycle of the second control signal and a duty cycle of the third control signal. CC'1, CC'2, and CC'3 are circuit parts for generating control signals having a duty cycle corresponding to the signal present at their input. Again, circuit parts CC1, CC2 and CC3 are shown in FIG. 1 as a single symbol with the reference CC123 and circuit parts CC'1, CC'2 and CC'3 are shown as a single symbol with the reference CC'123.

The output terminals of circuit parts CC1, CC2 and CC3 are also connected to respective input terminals of circuit part I. Circuit part I forms a first circuit part coupled to the control circuit of each of the LED drivers for sampling the duty cycles of the control signals and selecting the highest duty cycle. An output of circuit part I is connected to a first input terminal of comparator COMP4. Comparator COMP4 forms a first comparator coupled to the first circuit part for comparing the highest duty cycle with a reference signal representing a limit value of the duty cycle and for generating a first error signal depending on the outcome of the comparison. An output terminal of comparator COMP4 is connected to an input terminal of circuit part II. Circuit part II forms a second circuit part coupled to the first comparator for generating a parameter $\lambda$ depending on the first error signal. An output terminal of circuit part II is connected to respective first input terminals of multipliers MULT1, MULT2 and MULT3. First, second and third reference signals X1, Y1, Z1 representing respectively a level of the red, the green and the blue light are present during operation on respective second input terminals of multipliers MULT1, MULT2 and MULT3. These signals can for instance be adjusted manually by a user or be generated by e.g. a microprocessor, depending on the application that the circuit arrangement is used in.

The output terminal of sensor SE2 is connected to a first input terminal of comparator COMP5. At a second input terminal of comparator COMP5 a signal Y-set representing a desired intensity of the green light is present. Since the ratios between the intensities of red, green and blue light are controlled by the relative intensity control loop, the signal Y-set also represents a desired absolute intensity of the white light generated by the LED array LEDA. Again depending on the application this signal can for instance be manually adjustable by a user or generated by e.g. a microprocessor, depending on the application that the circuit arrangement is used in. Comparator COMP5 forms a second comparator for comparing a signal representing the actual light intensity with a signal representing the desired light intensity and for generating a second error signal depending on the outcome of the comparison. An output terminal of comparator COMP5 is connected to an input terminal of a circuit part III. Circuit part III forms a circuit part for generating a fourth reference signal representing a limit value of the duty cycle. An output terminal of circuit part III is connected to a second input terminal of comparator COMP4.

The operation of the embodiment shown in FIG. 1 is as follows.

When the embodiment shown in FIG. 1 is in operation the switching elements S1, S2 and S3 are rendered conductive and nonconductive periodically and alternately by respectively the first, second and third control signal. The amount current flowing through the parts R, G and B is controlled by (the duty cycles of) these control signals, as is the amount of red, green and blue light generated by them. The amounts of red green and blue light are sensed by the sensors SE1, SE2 and SE3 respectively. The signal λ generated by sensor SE1 represents the actual amount of red light and is present at the first input terminal of comparator COMP1. At the second input terminal of comparator COMP1 a signal is present that forms the first reference signal and represents a level of red light. The comparator COMP1 generates an error signal at its output terminal that is also present at the input of circuit part CC1. In dependency of this error signal, circuit part CC1 generates at its output terminal a signal that represents the duty cycle of the first control signal. This signal is also present at the input terminal of circuit part CC'1 and circuit part CC'1 generates a first control signal that has a duty cycle D1 that is proportional to the signal at its input terminal. The first control signal renders switching element S1 alternately and periodically conducting and non-conducting. Thus the amount of red light is controlled at a level corresponding to the first reference signal by means of a first control loop formed by sensor SE1, comparator COMP1 and circuit part CC1. In a similar way the amount of green light is controlled at a level that corresponds to the signal present at the second input terminal of comparator COMP2 that forms the second reference signal. The control loop controlling the amount of green light is formed by sensor SE2, comparator COMP2 and circuit part CC2. The amount of blue light in turn is controlled at a level that corresponds to the signal present at the second input terminal of comparator COMP3 that forms the third reference signal. The control loop controlling the amount of blue light is formed by sensor SE3, comparator COMP3 and circuit part CC3. In case the efficiency of the all the LEDs comprised in the LED array LEDA would be at a constant level, these three control loops alone would be able to control both the intensity of the light as well as its color in a satisfactory way. In practice, however, the efficiency of LEDs (more in particular of red LEDs) depends strongly on e.g. temperature and life time. For instance an increase in temperature causes a comparatively large decrease in the efficiency of the red LEDs. To compensate for this efficiency decrease the first control loop would increase the duty cycle of the first control signal. However, in case the efficiency of the red LEDs drops even further after the duty cycle of the first control signal has reached its maximum value, the intensity of the light generated by the LED array LEDA would decrease while the color of the light would show an undesirable shift. In addition, further undesirable effects such as flashing could result.

In the embodiment shown in FIG. 1, the occurrence of an undesirable color shift is prevented by means of a relative intensity control loop for limiting the duty cycles of the first, second and third control signal to a limit value by decreasing the values of the first, second and third reference signal by the same relative amount. The relative intensity control loop is formed by circuit part I, first comparator COMP4, circuit part II and multipliers MULT1, MULT2 and MULT3. At the input terminals of circuit part I the signals generated by the circuit parts CC1, CC2 and CC3 and representing the duty cycles of the first second and third control signal are present. Circuit part I generates an output signal equal to the biggest of its input signals. This signal is present at a first input terminal of first comparator COMP4. At the second input terminal of first comparator COMP4 a fourth reference signal representing a limit value of the duty cycle is present. In the embodiment shown in FIG. 1 this fourth reference signal is generated by an absolute intensity control loop comprised in the circuit arrangement that will be further discussed. It should be appreciated, however, that in other embodiments of circuit arrangements according to the invention this absolute intensity control loop can be dispensed with and the fourth reference signal could for instance be a signal with a constant value. In such embodiments the color point of the light generated by the LED array LEDA is controlled but not its intensity.

The first comparator COMP4 generates a first error signal that is present at the input of the second circuit part II. The second circuit part II generates a parameter λ depending on the first error signal. λ has a value that is bigger than zero and smaller than or equal to 1. Multipliers MULT1, MULT2 and MULT3 multiply the first, second and third reference signals (X1, Y1, Z1) that are present at their respective second input terminals by λ. In case λ is equal to 1, this multiplication does not change the values of the reference signals, and the value of the signal present at the second input terminal of each of the multipliers does not differ from the value of the signal present at its outputs. In that case the value of each of the signals present at the second input terminal of each of the multipliers represents the reference signal In case, however, λ is smaller than 1, this multiplication causes the value of the signal at the output terminal of each multiplier to be smaller than the value of the signal present at its second input terminal. In this case, the signals present at the output terminals of the multipliers form the first, second and third reference signal. A smaller value of λ corresponds to smaller values of the reference signals and therefor to smaller duty cycles of the control signals. These duty cycles are thus limited by adjusting the parameter λ. The relative intensity control loop thus adjusts the value of λ so that the duty cycle of each of the three control signals is smaller than or equal to the limit value represented by the fourth reference signal present at the second input terminal of first comparator COMP4. Since the ratio between the values of the reference signals is independent from λ, it remains unchanged when λ changes. As a result the ratio between the amounts of red, green and blue light also remains the same, so that the color of the light remains the same. The relative intensity control loop thus solves the problem of undesirable color shifts of the light when for instance the temperature changes.

As pointed out hereabove the fourth reference signal present at the second input terminal of first comparator COMP4 can be a signal with a constant value (in other embodiments than the one shown in FIG. 1). In such a case "duty cycle limiting" does not take place during normal operation. During normal operation λ is equal to 1 and the duty cycles of the control signals are all smaller than the limit value represented by the constant reference signal present at the second input terminal of first comparator COMP4. Only when, for instance due a decrease in the efficiency of part of the LEDs caused by a temperature increase, the duty cycle of one of the control signals becomes equal to the limit value, λ becomes smaller than 1 and duty cycle limiting takes place. In case the efficiency of the LEDs drops further, this further drop in efficiency is accompanied by a drop in the light intensity, since the value of λ decreases further so that the first, second and third reference signals decrease as well. Since a changing light intensity is considered highly undesirable in many applications, the embodiment shown in FIG. 1 is additionally equipped with an absolute intensity control loop, formed by second comparator COMP5 and third circuit part III. The signal Y generated by sensor SE2 and representing the actual amount of green light is present at the first input terminal of second comparator COMP5. At a second input terminal a signal Y-set representing a desired amount of green light is present. It is noted that the desired amount of green light represented by the signal Y-set is smaller than the signal Y1 present at the second input terminal of multiplier MULT2.

The second comparator COMP5 generates a second error signal in dependency of the outcome of the comparison of signal Y with signal Y-set. This second error signal is present at the input terminal of the third circuit part III. Circuit part III generates (in dependency of the second error signal) a fourth reference signal that is present at the second input terminal of the first comparator and that represents a limit value of the duty cycle. As a consequence, in the embodiment shown in FIG. 1 the reference signal representing a limit value of the duty cycle is not a signal with a constant value, but a value that can be adjusted over a wide range by the circuit part III. During stationary operation of the circuit arrangement the second reference signal present at the output of multiplier MULT2 will be approximately equal to the signal Y-set. This means that Y1*λ is approximately equal to Y-set. As pointed out hereabove, Y-set is smaller than Y1, so that λ is smaller than 1. The fact that λ is smaller than 1 means that "duty cycle limiting" is taking place during normal operation in the embodiment shown in FIG. 1, and not only as a result of a strong temperature increase as is the case in embodiments in which the fourth reference signal representing the limit value of the duty cycle is a signal with a constant value. In the embodiment shown in FIG. 1, the highest duty cycle of the control signals is controlled at a value substantially equal to the fourth reference signal. In case the efficiency of for instance the red LEDS drops, the first control loop will increase the duty cycle of the first control signal. In case, after this increase, the duty cycle of the first control loop is not the biggest duty cycle of the three control signals, nothing else will change. However, in case the duty cycle of the first control signal has become the biggest duty cycle of all the three control signals, the duty cycle of the first control signal has become substantially equal to the limit value represented by the fourth reference signal. As a consequence a further increase in duty cycle of the first control signal is prevented by the relative intensity control loop. In other words, in case the efficiency of the red LEDs further decreases, this does not result in an increase of the duty cycle of the first control signal but in a decrease of the duty cycles of the second and third control signal, since the relative intensity control loop strives to maintain the color point of the light generated by the LED array LEDA. A decrease in the duty cycle of the second control loop will result in a smaller amount of green light. This in turn is counteracted by the absolute intensity control loop that strives to maintain the amount of green light at a constant level: circuit part III will raise the reference signal to such an extent that the amount of green light is maintained at a constant level. A constant amount of green light together with a constant color point of the white light means that the amount of white light is also constant. Thus the circuit arrangement shown in FIG. 1 is capable of generating white light of a controlled color in a controlled amount over a wide temperature range and during a considerable lifetime.

Only in case the efficiency of part of the LEDs decreases so strongly that the limit value of the duty cycle represented by the reference signal becomes substantially equal to 100% (or to the highest value of the fourth reference signal that circuit part III can generate, for instance 95%), the absolute intensity control loop can no longer keep the light intensity at a constant level in case the efficiency of the LEDs drops even further. The occurrence of such a situation is less likely when the value of the signal Y-set is chosen lower.

In case the value of Y-set is manually adjustable, it can be adjusted so, that the highest duty cycle of the three control signals is for instance equal to 95%, when the LED array LEDA is at the highest temperature that is reached in practical operating conditions. As a consequence the highest duty cycle will be lower at a lower temperature. In other words the circuit arrangement will be able to control both the intensity as well as the color temperature of the light generated by the LED array LEDA at constant values over the whole temperature range between ambient temperature and the highest temperature under practical operating conditions. As a consequence the intensity and the color temperature of the light are the same immediately after switch-on of the circuit arrangement and when the LED array LEDA has reached stationary operating conditions.

Having described the invention in detail, those skilled in the art will appreciate that, given the present disclosure, modifications may be made to the invention without departing from the spirit of the inventive concept described herein. Therefore, it is not intended that the scope of the invention be limited to the specific embodiments illustrated and described.

What is being claimed is:

1. A device comprising:

an array of semiconductor light emitting devices;

a first driver for supplying current to a first portion of the devices in the array, the first driver comprising:

a first switch capable of adjusting an amount of current supplied to the first portion;

a first control circuit capable of generating a first control signal for controlling the conductive state of the first switch;

a first control loop capable of controlling an amount of light generated by the first portion at a level represented by a first reference signal by adjusting a duty cycle of the first control signal;

a second driver for supplying current to a second portion of the devices in the array, the second driver comprising:

a second switch capable of adjusting an amount of current supplied to the second portion;

a second control circuit capable of generating a second control signal for controlling the conductive state of the second switch;

a second control loop capable of controlling an amount of light generated by the second portion at a level represented by a second reference signal by adjusting a duty cycle of the second control signal; and a relative intensity control loop capable of limiting the duty cycles of the first and second control signals to a limit value, by decreasing values of the first and second reference signals by the same relative amount.

2. The device of claim 1, further comprising:

a third driver for supplying current to a third portion of the devices in the array, the third driver comprising:

a third switch capable of adjusting an amount of current supplied to the third portion;

a third control circuit capable of generating a third control signal for controlling the conductive state of the third switch;

a third control loop capable of controlling an amount of light generated by the third portion at a level represented by a third reference signal by adjusting a duty cycle of the third control signal;

wherein the relative intensity control loop comprising circuitry capable of limiting the duty cycles of the first, second, and third control signals to a limit value by decreasing values of the first, second, and third reference signals by the same relative amount.

3. The device of claim 2 wherein:

the devices in the first portion comprise devices emitting red light;

the devices in the second portion comprise devices emitting green light;

the devices in the third portion comprise devices emitting blue light.

4. The device of claim 1 wherein the relative intensity control loop comprises:

a first circuit part coupled to each of the control circuits, the first circuit capable of sampling the duty cycles of the control signals and selecting a highest duty cycle;

a first comparator coupled to the first circuit, wherein the first comparator compares the highest duty cycle with a third reference signal representing a limit value of the duty cycle and generates an error signal based on the outcome of the comparison;

a second circuit part coupled to the first comparator, wherein the second circuit part generates a parameter based on the error signal; and a multiplier coupled to the second circuit part and to the drivers, wherein the multiplier adjusts values of the first and second reference signals by multiplying them with the parameter.

5. The device of claim 4 wherein the absolute intensity control loop comprises:

a second comparator, wherein the second comparator compares a signal representing actual light intensity with a signal representing desired light intensity and generates an error signal based on an outcome of the comparison;

a third circuit part coupled between the first comparator and the second comparator, wherein the third circuit generates a fourth reference signal representing a limit value of the duty cycle.

6. The device of claim 5 wherein the signal representing the actual light intensity is a signal representing the actual light intensity of green light generated by the array.

7. A device comprising:

an array of semiconductor light emitting devices;

a plurality of driver circuits for supplying current to portions of the devices in the array, each driver circuit comprising:

a first comparator having a first input coupled to receive a signal representing an actual amount of light output by the portion of the array, a second input coupled to receive a reference signal, and an output, said first comparator providing a first error signal at the output based on comparison of the signal representing the actual amount of light and the reference signal;

a first circuit part having an input coupled to the terminal of the first comparator, the first circuit part also having an output, the first circuit part providing a signal corresponding to a duty cycle of a control signal at the output;

a second circuit part having an input coupled to the output of the first circuit part, the second circuit part also having an output, the second circuit part providing a control signal having a duty cycle proportional to the signal received from the first circuit part at the output; and a switch coupled to the output of the second circuit part; and a relative intensity control loop for limiting the duty cycles of each of the control signals to a limit value by decreasing the values of the reference signals by the same relative amount.

8. The device of claim 7 wherein the relative intensity control loop comprises:

a third circuit part having inputs coupled between the inputs of each of the second circuit parts and the outputs of each of the first circuit parts, the third circuit also having an output, the third circuit selecting a highest duty from the duty cycles at each of the inputs and providing the highest duty cycle to the output;

a second comparator having a first input coupled to receive the output of the third circuit part, a second input coupled to receive an additional reference signal, and an output, the second comparator providing a second error signal to the output based on comparison of the signals at the first input and second input;

a fourth circuit part having an input coupled to the output of the second comparator, the fourth circuit part also having an output, the fourth circuit part providing a parameter to the output based on the second error signal; and a multiplier having an input coupled to the output of the fourth circuit part, inputs coupled to the reference signals of the driver circuits, and outputs, the multiplier multiplying the reference signals by the parameter received from the fourth circuit part and providing the multiplied reference signals to the outputs.

9. The device of claim 8 further comprising an absolute intensity control loop comprising:

a third comparator having a first input coupled to receive a signal representing actual light intensity from the array, a second input coupled to receive a signal representing desired light intensity from the array, and an output, the comparator generating a third error signal based on comparison of the signals at the first and second inputs; and a fifth circuit part having an input coupled to the output of the third comparator and an output coupled to the second input of the second comparator, the fifth circuit part providing to the output the additional reference signal, the additional reference signal representing a limit value of the duty cycle.

* * * * *